US011555639B2

(12) United States Patent
Raimbault et al.

(10) Patent No.: US 11,555,639 B2
(45) Date of Patent: Jan. 17, 2023

(54) HVAC SYSTEM

(71) Applicant: TRANE INTERNATIONAL INC., Davidson, NC (US)

(72) Inventors: Yves Jacques Raimbault, Uxegney (FR); Philippe Del Marcel Tisserand, Eloyes (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 79 days.

(21) Appl. No.: 17/009,096

(22) Filed: Sep. 1, 2020

(65) Prior Publication Data

US 2021/0063070 A1 Mar. 4, 2021

(30) Foreign Application Priority Data

Sep. 3, 2019 (EP) ..... 19195245

(51) Int. Cl.
*F25B 1/00* (2006.01)
*F25B 49/02* (2006.01)
(Continued)

(52) U.S. Cl.
CPC ..... *F25B 49/02* (2013.01); *F25B 13/00* (2013.01); *F25B 29/003* (2013.01); *F25B 39/00* (2013.01);
(Continued)

(58) Field of Classification Search
CPC ..... F25B 29/003; F25B 13/00; F25B 30/02; F25B 39/00; F25B 40/00; F25B 41/003;
(Continued)

(56) References Cited

U.S. PATENT DOCUMENTS

2015/0285539 A1* 10/2015 Kopko ..... F25B 49/02 62/324.1
2018/0051922 A1* 2/2018 Ochiai ..... F25B 49/02
(Continued)

FOREIGN PATENT DOCUMENTS

DE 102016103250 A1 9/2016
WO 2006/024182 A2 3/2006
(Continued)

OTHER PUBLICATIONS

Extended European Search Report; European Patent Application No. 19195245.6, dated Feb. 13, 2020 (9 pages).

*Primary Examiner* — Henry T Crenshaw
*Assistant Examiner* — Kamran Tavakoldavani
(74) *Attorney, Agent, or Firm* — Hamre, Schumann, Mueller & Larson, P.C.

(57) ABSTRACT

There is provided a HVAC system comprising: a fluid circuit for conveying a refrigerant; a compressor for compressing the refrigerant; three heat exchangers defining an evaporator, an outdoor exchanger and a heat recovery exchanger provided along the fluid circuit; an expansion valve provided along the fluid circuit; and a receiver connected in parallel to the expansion valve, wherein a fill valve is located between the receiver and a connection upstream of the expansion valve and a drain valve is located between the receiver and a connection downstream of the expansion valve; wherein the fluid circuit comprises a plurality of valves which are configured to be controlled based on a selected operating mode such that at least one of the outdoor exchanger and the heat recovery exchanger is connected to a discharge line of the compressor and in series with one of the other heat exchangers which is connected to a suction line of the compressor, with the expansion valve disposed between the heat exchangers; wherein the fill and drain valves are configured to be controlled to store a volume of
(Continued)

refrigerant in the receiver so as to provide an effective refrigerant charge in the fluid circuit that corresponds to the selected operating mode.

15 Claims, 9 Drawing Sheets

(51) Int. Cl.

| | |
|---|---|
| ***F25B 41/31*** | (2021.01) |
| ***F25B 41/20*** | (2021.01) |
| ***F25B 41/40*** | (2021.01) |
| ***F25B 13/00*** | (2006.01) |
| ***F25B 29/00*** | (2006.01) |
| ***F25B 39/00*** | (2006.01) |
| ***F25B 43/00*** | (2006.01) |
| ***F25B 47/02*** | (2006.01) |

(52) U.S. Cl.
CPC ..... *F25B 41/20* (2021.01); *F25B 41/31* (2021.01); *F25B 41/40* (2021.01); *F25B 43/003* (2013.01); *F25B 47/02* (2013.01); *F25B 2313/0292* (2013.01); *F25B 2313/02741* (2013.01); *F25B 2400/04* (2013.01); *F25B 2600/2515* (2013.01)

(58) Field of Classification Search
CPC ..... F25B 41/04; F25B 41/062; F25B 41/20; F25B 41/24; F25B 41/31; F25B 6/02
See application file for complete search history.

(56) References Cited

U.S. PATENT DOCUMENTS

| | | | | |
|---|---|---|---|---|
| 2020/0240680 | A1* | 7/2020 | Lv | F25B 13/00 |
| 2021/0139151 | A1* | 5/2021 | Lu | B64D 11/04 |

FOREIGN PATENT DOCUMENTS

| | | | |
|---|---|---|---|
| WO | 2017/176838 | A1 | 10/2017 |
| WO | 2018/185841 | A1 | 10/2018 |
| WO | 2019/064248 | A1 | 4/2019 |

* cited by examiner

HVAC SYSTEM

The disclosure relates to a HVAC system and particularly to a four-pipe HVAC system having a variable refrigerant charge.

BACKGROUND

Four-pipe HVAC systems comprise separate heating and cooling portions, each having its own heat exchanger coil with supply and return pipes. The heating and cooling portions can be operated independently such that four-pipe systems are able to provide simultaneous heating and cooling.

Four-pipe systems have a number of modes based on the desired operation. The effective volume of the system varies depending on the mode of operation being used (e.g. based on the volume of the heat exchanger(s) utilised in the mode of operation). Consequently, the volume of refrigerant (i.e. the refrigerant charge) in the system is typically a compromise to provide the best overall performance.

However, it is desirable to provide a four-pipe system which has improved performance.

SUMMARY

In accordance with a first aspect there is provided a HVAC system comprising: a fluid circuit for conveying a refrigerant; a compressor for compressing the refrigerant; three heat exchangers defining an evaporator, an outdoor exchanger and a heat recovery exchanger provided along the fluid circuit; an expansion valve provided along the fluid circuit; and a receiver connected in parallel to the expansion valve, wherein a fill valve is located between the receiver and a connection upstream of the expansion valve and a drain valve is located between the receiver and a connection downstream of the expansion valve; wherein the fluid circuit comprises a plurality of valves which are configured to be controlled based on a selected operating mode such that at least one of the outdoor exchanger and the heat recovery exchanger is connected to a discharge line of the compressor and in series with one of the other heat exchangers which is connected to a suction line of the compressor, with the expansion valve disposed between the heat exchangers; wherein the fill and drain valves are configured to be controlled to store a volume of refrigerant in the receiver so as to provide an effective refrigerant charge in the fluid circuit that corresponds to the selected operating mode.

The evaporator and/or the heat recovery exchanger may be refrigerant to water heat exchangers and/or the outdoor exchanger may be a refrigerant to air heat exchanger.

An internal volume of the outdoor exchanger may be larger than an internal volume of the heat recovery exchanger and/or the evaporator.

The operating mode may be selected from one or more of the following: a chiller mode in which the outdoor exchanger is connected to the discharge line and the evaporator is connected to the suction line; a heat pump mode in which the heat recovery exchanger is connected to the discharge line and the outdoor exchanger is connected to the suction line; a defrost mode in which the outdoor exchanger is connected to the discharge line and the heat recovery exchanger is connected to the suction line; a heat recovery mode in which the heat recovery exchanger is connected to the discharge line and the evaporator is connected to the suction line; and a partial heat recovery mode in which both the heat recovery exchanger and the outdoor exchanger are connected to the discharge line and the evaporator is connected to the suction line.

The effective refrigerant charge required for the chiller mode may be greater than for the heat pump mode; and/or the effective refrigerant charge required for the defrost mode may be greater than for the heat pump mode; and/or the effective refrigerant charge required for the heat pump mode may be greater than for the heat recovery mode.

In the partial heat recovery mode, a hot gas bypass valve upstream of the heat recovery exchanger may divert refrigerant to the outdoor exchanger in order to control the heat recovery at the heat recovery exchanger.

The plurality of valves may comprise a four-way valve which is configured to connect one of the outdoor exchanger and the heat recovery exchanger to the discharge line and the other of the outdoor exchanger and the heat recovery exchanger to the suction line via a bypass branch.

The fluid circuit may comprise a liquid line connected between the expansion valve and each of the heat recovery exchanger and the outdoor exchanger, wherein the liquid lines are provided on an upstream side of the expansion valve.

The fluid circuit may comprise a return line connected between the expansion valve and each of the heat exchangers, wherein the return lines are provided on a downstream side of the expansion valve.

The plurality of valves comprises a valve provided along each of the return lines so as to allow the heat exchanger which is connected to the suction line of the compressor to be connected to the expansion valve.

A drain line with a pressure relief valve may be provided between the return lines and the liquid lines.

The drain valve may connect to the return lines downstream of the receiver.

The HVAC system may further comprise a suction line heat exchanger connected to a portion of the fluid circuit which is upstream of the expansion valve and to the suction line.

A bypass line may be provided across the suction line heat exchanger on the portion of the fluid circuit which is upstream of the expansion valve; wherein a valve is provided for controlling the flow of refrigerant through the bypass line in order to bypass the suction line heat exchanger.

The HVAC system may further comprise a pressure line connecting the discharge line to the receiver and having a pressure relief valve disposed between the compressor and the receiver.

The HVAC system may further comprise a drier located upstream of the expansion valve.

The HVAC system may further comprise a controller which controls the plurality of valves in response to the selected operating mode.

The evaporator may comprise a cold water supply pipe and a cold water return pipe, and the heat recovery exchanger may comprise a hot water supply pipe and a hot water return pipe.

DETAILED DESCRIPTION

Figure 1:
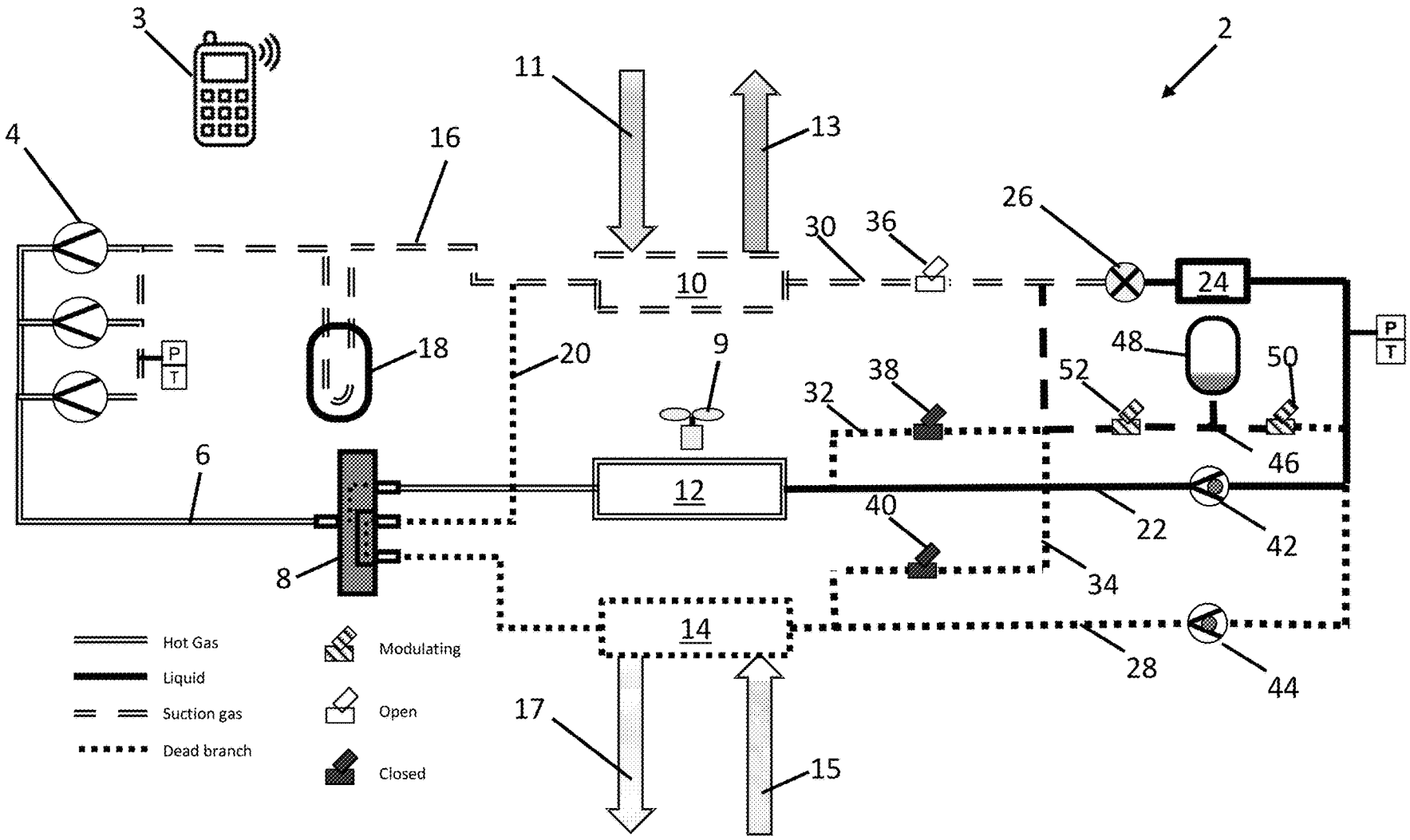
FIG. 1 is a schematic diagram of a HVAC system according to an embodiment of the invention operating in a chiller mode.

FIGS. 1 to 4 each show a schematic diagram of a HVAC system 2 according to an embodiment of the invention. The HVAC system 2 comprises a plurality of compressors 4 arranged in parallel; although in other arrangements only a single compressor 4 may be used. Discharge (outlet) ports of the compressors 4 are connected to a common discharge line 6 via a manifold. The discharge line 6 is connected to a first (discharge) port of a four-way valve 8.

The HVAC system 2 further comprises three heat exchangers, which form an evaporator 10, an outdoor exchanger 12 having a fan 9, and a heat recovery exchanger 14. The heat exchangers are arranged in parallel. The evaporator 10 comprises a cold water supply pipe 11 and a cold water return pipe 13. The heat recovery exchanger 14 comprises a hot water supply pipe 15 and a hot water return pipe 17.

A second port of the valve 8 connects to a first side of the outdoor exchanger 12, a third port of the valve 8 is connected to a bypass branch 20 and a fourth port of the valve 8 is connected to a first side of the heat recovery exchanger 14.

A second side of the outdoor exchanger 12 is connected to a first liquid line 22 which is connected to a drier 24 and an electronic expansion valve (EXV) 26 (although other expansion valves may be used) arranged in series. Similarly, a second side of the heat recovery exchanger 14 is connected to a second liquid line 28 which is also connected to the drier 24 and EXV 26. In the arrangement shown, the first and second liquid lines 22, 28 are formed as a common portion adjacent the drier 24 which then splits into first and second portions which connect to the outdoor exchanger 12 and the heat recovery exchanger 14.

An outlet of the EXV 26 is connected to a first return line 30 which feeds into a first side of the evaporator 10. A second side of the evaporator 10 is connected to a suction line 16 that extends between the evaporator 10 and the compressors 4. The bypass branch 20 joins the suction line 16 between the evaporator 10 and the compressors 4. The bypass branch 20 thus connects to the suction line 16 downstream of the evaporator 10. An accumulator 18 is provided along the suction line 16.

A second return line 32 extends from downstream of the EXV 26 and connects to the first liquid line 22 adjacent the outdoor exchanger 12. A third return line 34 extends from downstream of the EXV 26 and connects to the second liquid line 28 adjacent the heat recovery exchanger 14. In the arrangement shown, the second and third return lines 32, 34 are formed as a common portion which branches off the first return line 30 and then splits into first and second portions which join the first and second liquid lines 22, 28.

Valves 36, 38, 40 are provided along the first, second and third return lines 30, 32, 34 respectively. Non-return valves 42, 44 are also provided along the first and second liquid lines 22, 28 respectively.

A receiver line 46 comprising a receiver 48 is connected between the first and second liquid lines 22, 28 and between the second and third return lines 32, 34. Specifically, the receiver line 46 is coupled to the common portions of the liquid lines 22, 28 and the return lines 32, 34. A fill valve 50 is provided along the receiver line 46 on a first side of the receiver 48 and a drain valve 52 is provided along the receiver line 46 on a second side of the receiver 48. The fill valve 50 is provided between the liquid lines 22, 28 and the receiver 48, whereas the drain valve 52 is provided between the receiver 48 and the return lines 32, 34. The receiver line 46 is thus arranged in parallel to the EXV 26 and connects on either side of the EXV 26, with the fill valve 50 on the upstream, high-pressure side and the drain valve 52 on the downstream, low-pressure side. There is therefore a pressure differential across the receiver line 46.

FIG. 1 shows the system 2 in a chiller mode. In the chiller mode, the four-way valve 8 connects the first port to the second port such that the discharge line 6 is connected to the outdoor exchanger 12. In this mode, the fan 9 of the outdoor exchanger is operating. The four-way valve 8 also connects the third port to the fourth port, although those ports are not used in this mode, as described further below.

In the chiller mode, the valve 36 on the first return line 30 is set in an open position, whereas the valves 38 and 40 on the second the third return lines 32, 34 are set in a closed position.

Refrigerant in the form of hot, compressed gas is discharged from the compressors 4 to the discharge line 6. The hot, compressed gas passes through the four-way valve 8 to the outdoor exchanger 12. In the outdoor exchanger 12, the hot, compressed gas is cooled by the outdoor air which flows over coils of the outdoor exchanger 12 by virtue of the fan 9. This causes the refrigerant to condense into liquid form. The liquid refrigerant then exits the outdoor exchanger 12 via the first liquid line 22 and passes through the drier 24 to the EXV 26. The EXV 26 reduces the pressure of the refrigerant, thereby also lowering its temperature. Pressure and temperature transducers can be used to control the amount of subcooling applied to the refrigerant in the outdoor exchanger 12.

The cool, liquid refrigerant passes along the first return line 30 through the open valve 36 and into the evaporator 10. Water flows into the evaporator 10 via the cold water supply pipe 11. The water is warmer than the refrigerant passing through the evaporator 10 and so the refrigerant absorbs heat from the water, thereby reducing the temperature of the water and increasing the temperature of the refrigerant. The temperature of the refrigerant is increased sufficiently to cause the refrigerant to evaporate back into gaseous form. The cooled water is discharged from the evaporator 10 via the cold water return pipe 13 and can be used to provide cooling to the interior of a building. The water may be cooled to a temperature of between −12° C. and +20° C.

The low-pressure gaseous refrigerant is returned to the compressors 4 along the suction line 16 and via the accumulator 18. Pressure and temperature transducers can be used to control the amount of superheating applied to the refrigerant in the evaporator 10.

The outdoor exchanger 12 has a relatively large volume (which is larger than the evaporator 10 and heat recovery exchanger 14 since it utilises air instead of water) and so a larger refrigerant charge is required in the refrigerant circuit during this mode of operation. Accordingly, the fill and drain valves 50, 52 are modulated so as to release the full volume of the refrigerant from the receiver 48 to the circuit via the first return line 30.

The heat recovery exchanger 14 is not used in the chiller mode and so water does not flow through the hot water supply pipe 15 and the hot water return pipe 17.

As can be seen, in the chiller mode, the chilled water heat is rejected in the outdoor ambient air with ventilation.

Figure 2:
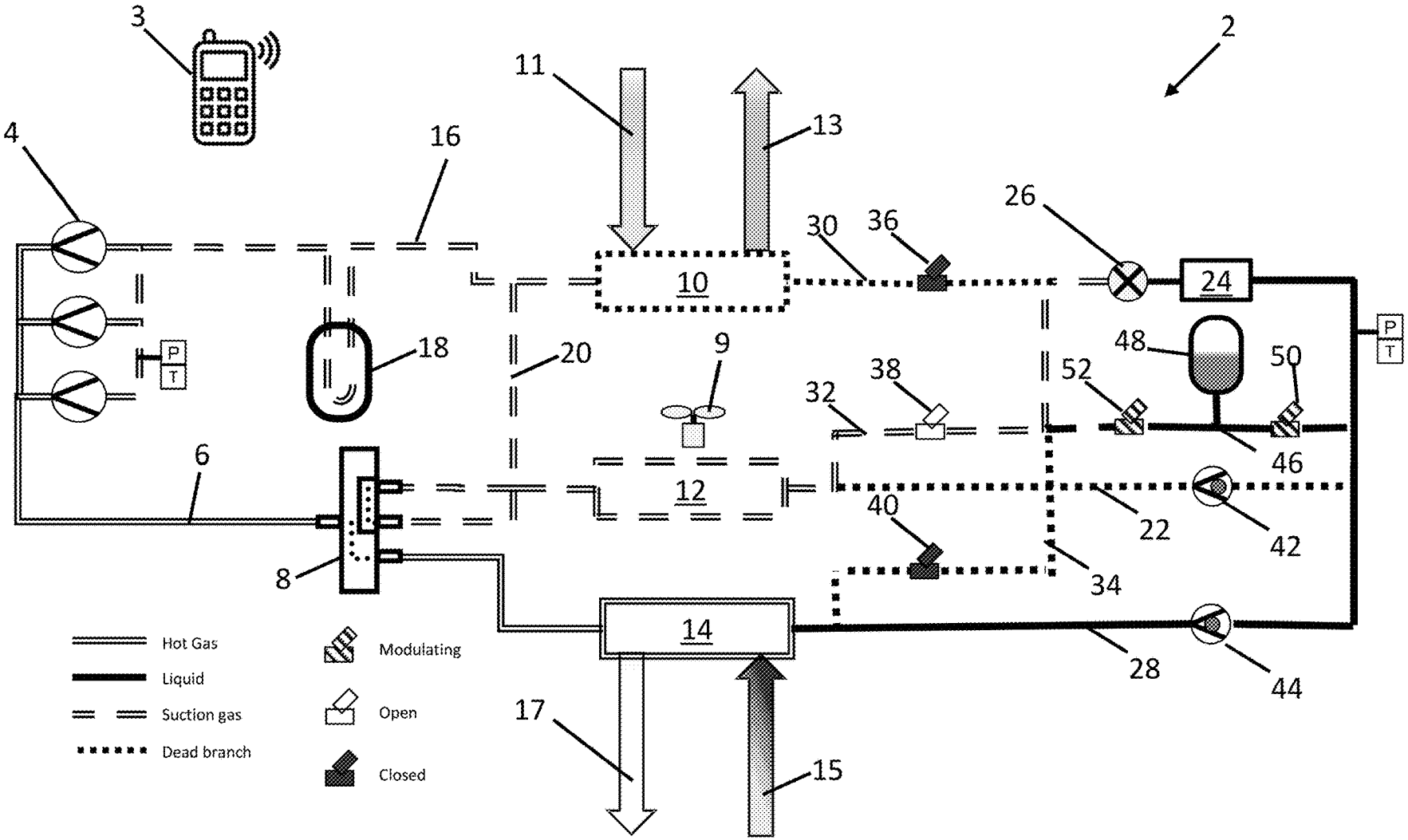
FIG. 2 shows the HVAC system operating in a heat pump mode.

FIG. 2 shows the system 2 in a heat pump mode. In the heat pump mode, the four-way valve 8 connects the first port to the fourth port such that the discharge line 6 is connected to the heat recovery exchanger 14. The four-way valve 8 also connects the second port to the third port, such that the outdoor exchanger 12 is connected to the bypass branch 20.

In the heat pump mode, the valves 36 and 40 on the first and third return lines 30, 34 are set in a closed position, whereas the valve 38 on the second return line 32 is set in an open position.

Refrigerant in the form of hot, compressed gas is discharged from the compressors 4 to the discharge line 6. The hot, compressed gas passes through the four-way valve 8 to the heat recovery exchanger 14. Water flows into the heat recovery exchanger 14 via the hot water supply pipe 15. The water is cooler than the refrigerant passing through the heat recovery exchanger 14 and so the water absorbs heat from the refrigerant, thereby increasing the temperature of the water and decreasing the temperature of the refrigerant. The heated water is discharged from the heat recovery exchanger 14 via the hot water return pipe 17 and can be used to provide heating to the interior of the building. The water may be heated to a temperature of between 25° C. to 60° C.

In the heat recovery exchanger 14, the hot, compressed gas is therefore cooled by the water which flows through the heat recovery exchanger 14. This causes the refrigerant to condense into liquid form. The liquid refrigerant then exits the heat recovery exchanger 14 via the first liquid line 28 and passes through the drier 24 to the EXV 26. The EXV 26 reduces the pressure of the refrigerant, thereby also lowering its temperature. Pressure and temperature transducers can be used to control the amount of subcooling applied to the refrigerant in the heat recovery exchanger 14.

The cool, liquid refrigerant passes along the second return line 32 through the open valve 38 and into the outdoor exchanger 12. The fan 9 is activated so as to draw ambient air over the outdoor exchanger 12. The air is warmer than the refrigerant passing through the outdoor exchanger 12 and so the refrigerant absorbs heat from the air, thereby reducing the temperature of the air and increasing the temperature of the refrigerant. The temperature of the refrigerant is increased sufficiently to cause the refrigerant to evaporate back into gaseous form. The outdoor exchanger 12 thus acts as an evaporator in this mode of operation.

The low-pressure gaseous refrigerant passes through the four-way valve 8 and is returned to the compressors 4 along the bypass branch 20 and via the accumulator 18. Pressure and temperature transducers can be used to control the amount of superheating applied to the refrigerant in the outdoor exchanger 12.

As the outdoor exchanger 12 is operating as an evaporator in the heat pump mode and thus receiving liquid refrigerant, a smaller refrigerant charge is required during this mode of operation compared with the chiller mode described previously. Accordingly, the fill and drain valves 50, 52 are modulated so as to allow refrigerant to partially fill the receiver 48 in order to ensure that the correct refrigerant charge is present in the circuit.

As can be seen, in the heat pump mode, the heat is taken out of the ambient air and passed to the hot water loop.

Figure 3:
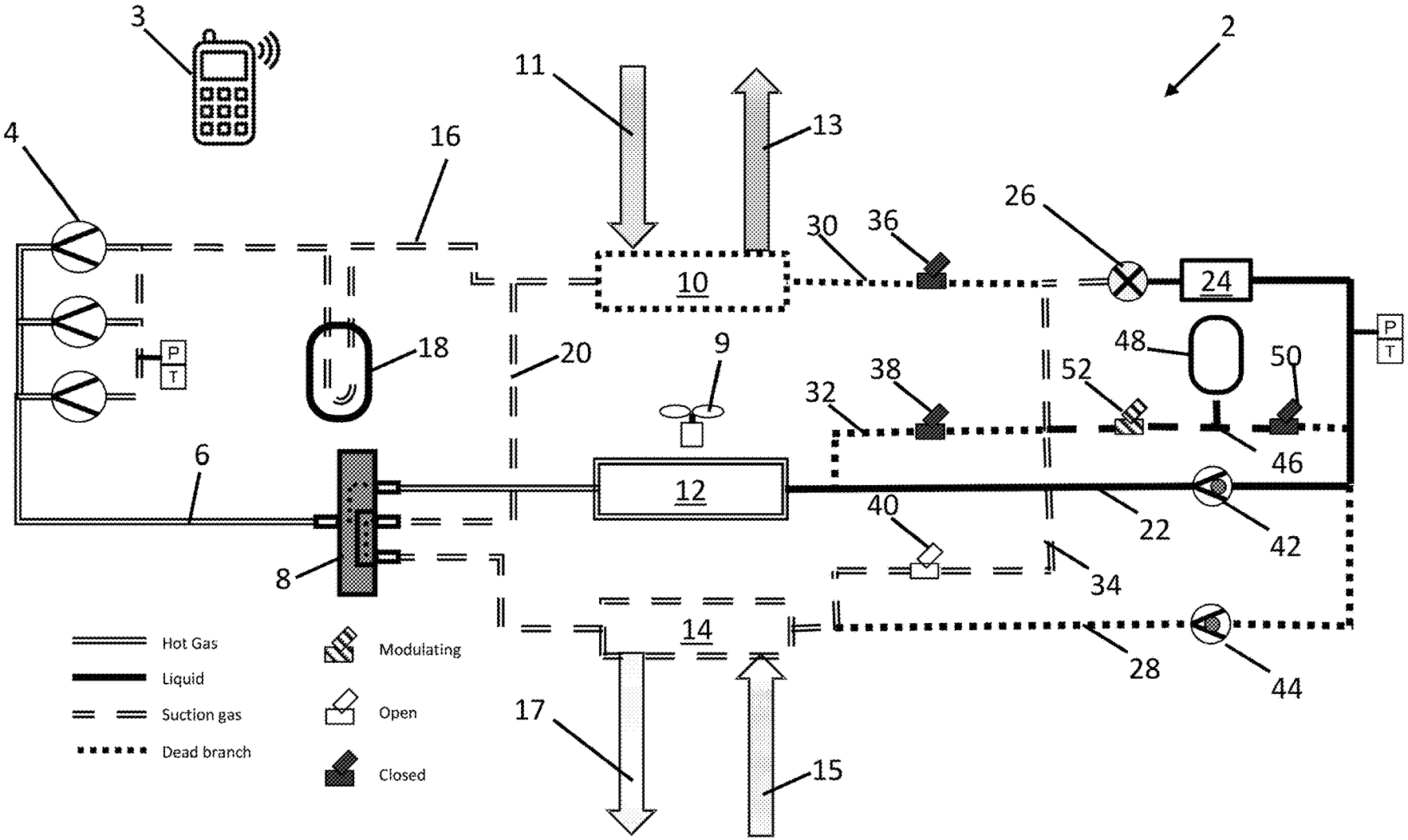
FIG. 3 shows the HVAC system operating in a defrost mode.

FIG. 3 shows the system 2 in a defrost mode. This mode is used after the heat pump mode to defrost the outdoor coil 12 which acts as an evaporator during that mode. In the defrost mode, the four-way valve 8 connects the first port to the second port such that the discharge line 6 is connected to the outdoor exchanger 12. In this mode, the fan 9 of the outdoor exchanger is not operating. The four-way valve 8 also connects the third port to the fourth port, such that the heat recovery exchanger 14 is connected to the bypass branch 20.

In the defrost mode, the valves 36, 38 on the first and second return lines 30, 32 are set in a closed position, whereas the valve 40 on the third return line 34 is set in an open position.

Refrigerant in the form of hot, compressed gas is discharged from the compressors 4 to the discharge line 6. The hot, compressed gas passes through the four-way valve 8 to the outdoor exchanger 12 thereby defrosting any ice formed on it. This causes the refrigerant to condense into liquid form. The liquid refrigerant then exits the outdoor exchanger 12 via the first liquid line 22 and passes through the drier 24 to the EXV 26. The EXV 26 reduces the pressure of the refrigerant, thereby also lowering its temperature. Pressure and temperature transducers can be used to control the amount of subcooling applied to the refrigerant in the outdoor exchanger 12.

The cool, liquid refrigerant passes along the third return line 34 through the open valve 40 and into the heat recovery exchanger 14. In the defrost mode, water does not flow into or out of the heat recovery exchanger 14 via the hot water supply pipe 15 and the hot water return pipe 17. In the heat recovery exchanger 14, the temperature of the refrigerant is increased sufficiently to cause the refrigerant to evaporate back into gaseous form. The heat recovery exchanger 14 thus acts as an evaporator in this mode of operation.

The low-pressure gaseous refrigerant passes through the four-way valve 8 and is returned to the compressors 4 along the bypass branch 20 and via the accumulator 18. Pressure and temperature transducers can be used to control the amount of superheating applied to the refrigerant in the heat recovery exchanger 14.

The refrigerant charge requirement for the defrost mode corresponds to the chiller mode since the outdoor exchanger 12 is used as a condenser in both modes and the evaporator 10 and heat recovery exchanger 14 have a substantially similar volume.

Accordingly, like the chiller mode, the defrost mode requires sufficient refrigerant that the receiver 48 is drained entirely of refrigerant. In the defrost mode, the fill valve 50 may be closed and the drain valve 52 modulated so as to slowly release the full volume of the refrigerant from the receiver 48 to the circuit via the third return line 34, thereby improving the defrost efficiency.

The evaporator 10 is not used in the defrost mode and so water does not flow through the cold water supply pipe 11 and the cold water return pipe 13.

Figure 4:
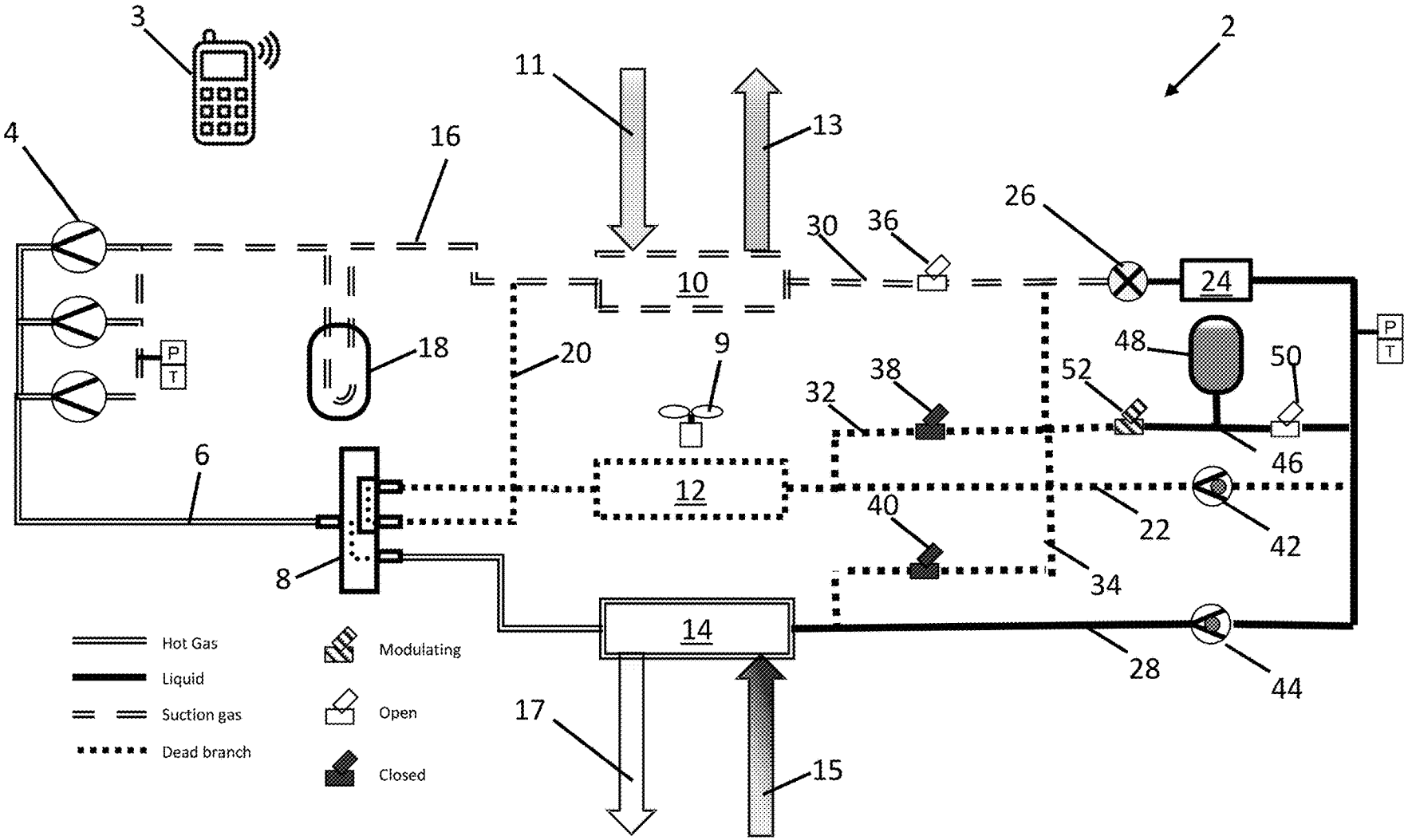
FIG. 4 shows the HVAC system operating in a heat recovery mode.

FIG. 4 shows the system 2 in a heat recovery mode. In the heat recovery mode, the four-way valve 8 connects the first port to the fourth port such that the discharge line 6 is connected to the heat recovery exchanger 14. The four-way valve 8 also connects the second port to the third port, although those ports are not used in this mode, as described further below.

In the heat recovery mode, the valves 38 and 40 on the second and third return lines 32, 34 are set in a closed position, whereas the valve 36 on the first return line 30 is set in an open position.

Refrigerant in the form of hot, compressed gas is discharged from the compressors 4 to the discharge line 6. The hot, compressed gas passes through the four-way valve 8 to the heat recovery exchanger 14. Water flows into the heat recovery exchanger 14 via the hot water supply pipe 15. The water is cooler than the refrigerant passing through the heat recovery exchanger 14 and so the water absorbs heat from the refrigerant, thereby increasing the temperature of the water and decreasing the temperature of the refrigerant. The heated water is discharged from the heat recovery exchanger 14 via the hot water return pipe 17 and can be used to provide heating to the interior of the building.

In the heat recovery exchanger 14, the hot, compressed gas is therefore cooled by the water which flows through the heat recovery exchanger 14. This causes the refrigerant to condense into liquid form. The liquid refrigerant then exits the heat recovery exchanger 14 via the first liquid line 28 and passes through the drier 24 to the EXV 26. The EXV 26 reduces the pressure of the refrigerant, thereby also lowering its temperature. Pressure and temperature transducers can be used to control the amount of subcooling applied to the refrigerant in the heat recovery exchanger 14.

The cool, liquid refrigerant passes along the first return line 30 through the open valve 36 and into the evaporator 10. Water flows into the evaporator 10 via the cold water supply pipe 11. The water is warmer than the refrigerant passing through the evaporator 10 and so the refrigerant absorbs heat from the water, thereby reducing the temperature of the water and increasing the temperature of the refrigerant. The temperature of the refrigerant is increased sufficiently to cause the refrigerant to evaporate back into gaseous form. The cooled water is discharged from the evaporator 10 via the cold water return pipe 13 and can be used to provide cooling to the interior of a building.

The low-pressure gaseous refrigerant is returned to the compressors 4 along the suction line 16 and via the accumulator 18. Pressure and temperature transducers can be used to control the amount of superheating applied to the refrigerant in the evaporator 10.

As described previously, the evaporator 10 and the heat recovery exchanger 14 have a smaller volume than the outdoor exchanger 12 such that in the heat recovery mode, the refrigerant charge requirement is at its minimum. Accordingly, in this mode, the fill valve 50 is opened and the drain valve 52 is modulated causing the receiver 48 to fill with refrigerant until it is almost full. This reduces the effective refrigerant charge in the circuit and thus ensures efficient operation.

The outdoor exchanger 12 is not used in the heat recovery mode and so the fan 9 is not activated.

As can be seen, in the heat recovery mode, the chilled water heat is recovered on the hot water loop.

The settings of the system 2 can be controlled using a suitable controller, such as the controller 3, shown in FIGS. 1 to 4. In particular, the controller 3 is able to control the positions of the various valves and other components in response to the current operating mode and feedback from various sensors. The controller 3 may be a wired unit or a wireless unit. As described previously, the release of the refrigerant from the receiver 48 can be used to provide the desired refrigerant liquid subcooling.

Accordingly, the subcooling can be used to gauge whether to fill or drain the receiver 48 (e.g. based on a comparison between a current and a subcooling setpoint) and thus avoid the need for any level sensors in the receiver 48. Alternatively, the receiver 48 may have a level sensor which is used to directly determine the volume of refrigerant present in the receiver 48. Alternatively, the volume of refrigerant may be determined based on the flow through the fill and drain valves 50, 52.

FIGS. 5 to 9 each show a schematic diagram of a HVAC system 102 according to another embodiment of the invention. The HVAC system 102 generally includes the components described previously in relation to the system 2 and those components are denoted by corresponding reference numerals in FIGS. 5 to 9. Further, those components are arranged in the same manner in the system 102 and so the subsequent description of FIGS. 5 to 9 will focus on the additional components and functionality included in the system 102.

The system 102 further comprises a suction line heat exchanger (SLHX) 54. The SLHX 54 is connected along the suction and liquid return lines. Specifically, the SLHX 54 is connected between the drier 24 and the expansion valve 26 on the liquid return line and between the evaporator 10 and the compressors 4 on the suction line 16. A three-way valve 56 is provided upstream of the SLHX 54 and connects to a bypass line 58. The valve 56 can be controlled to modulate the liquid passing through the SLHX 54 and to bypass the SLHX 54 entirely, as will be described further below.

The system 102 further comprises a pressure relief valve (configured at, for example, 6 bar) 60 provided along a pressure line 62 connected between the discharge line 6 and the receiver 48.

A further pressure relief valve (configured at, for example, 36 bar) 64 is provided along a drain line 66 connected between the liquid return lines 30, 32, 34 and the second liquid line 28. The pressure relief valve 64 allows liquid refrigerant to be released when the system is not in use to avoid reaching burst pressure when refrigerant is trapped in between the EXV 26 and the check valves 42, 44 or between the EXV 26 and the valves 36, 38, 40.

An evaporator gas valve 68 is provided adjacent the evaporator 10 on the second side between the evaporator 10 and the SLHX 54. The evaporator gas valve 68 avoids freezing of the evaporator 10 when in the heat pump mode when the need for cooling is turned off and water is not supplied to the evaporator 10. Similarly, an outdoor gas valve 70 is provided adjacent the outdoor exchanger 12 on the first side between the heat exchanger 12 and the four-way valve 8 for when the outdoor exchanger 12 is not being used.

The system 102 further comprises a hot gas bypass valve 72 provided along a bypass line 74. The bypass line connects at one end between the four-way valve 8 and the heat recovery exchanger 14 and at the other end between the outdoor exchanger 12 and the four-way valve 8 (or more specifically between the outdoor exchanger 12 and the gas valve 70).

Figure 5:
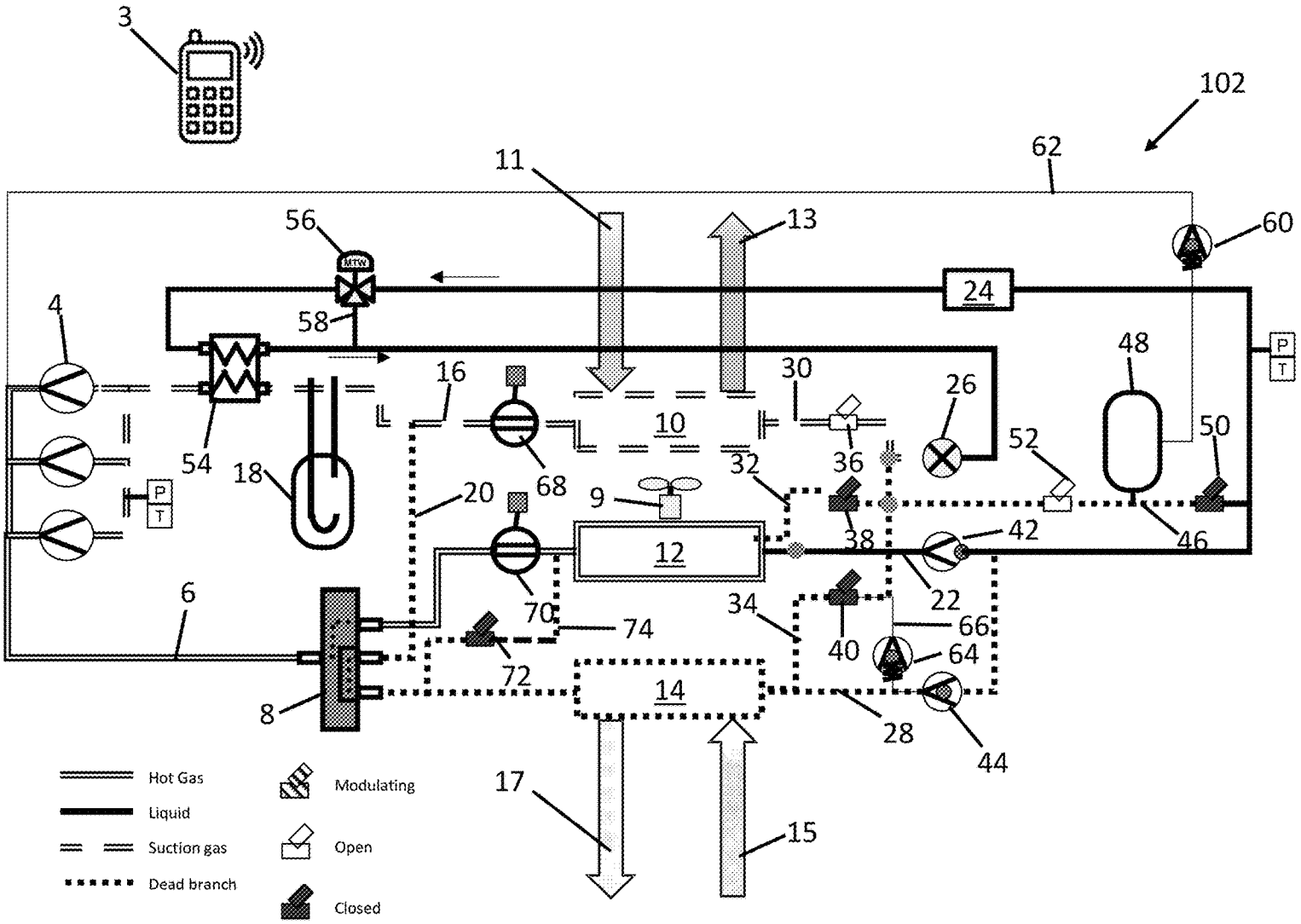
FIG. 5 is a schematic diagram of a HVAC system according to another embodiment of the invention operating in a chiller mode.

FIG. 5 shows the system 102 in the chiller mode. In the chiller mode, the four-way valve 8 connects the first port to the second port such that the discharge line 6 is connected to the outdoor exchanger 12. In this mode, the fan 9 of the outdoor exchanger is operating. The four-way valve 8 also connects the third port to the fourth port, although those ports are not used in this mode, as described further below.

In the chiller mode, the valve 36 on the first return line 30 is set in an open position, whereas the valves 38 and 40 on the second the third return lines 32, 34 are set in a closed position. The gas valves 68 and 70 are also set in an open position. The hot gas bypass valve 72 is closed.

Refrigerant in the form of hot, compressed gas is discharged from the compressors 4 to the discharge line 6. The hot, compressed gas passes through the four-way valve 8 to the outdoor exchanger 12. In the outdoor exchanger 12, the hot, compressed gas is cooled by the outdoor air which flows over coils of the outdoor exchanger 12 by virtue of the fan 9. This causes the refrigerant to condense into liquid form. The liquid refrigerant then exits the outdoor exchanger 12 via the first liquid line 22 and passes through the drier 24 to the EXV 26 via the three-way valve 56 and the SLHX 54. The EXV 26 reduces the pressure of the refrigerant, thereby also lowering its temperature.

Pressure and temperature transducers can be used to control the amount of subcooling applied to the refrigerant in the outdoor exchanger 12.

The cool, liquid refrigerant passes along the first return line 30 through the open valve 36 and into the evaporator 10. Water flows into the evaporator 10 via the cold water supply pipe 11. The water is warmer than the refrigerant passing through the evaporator 10 and so the refrigerant absorbs heat from the water, thereby reducing the temperature of the water and increasing the temperature of the refrigerant. The temperature of the refrigerant is increased sufficiently to cause the refrigerant to evaporate back into gaseous form. The cooled water is discharged from the evaporator 10 via the cold water return pipe 13 and can be used to provide cooling to the interior of a building.

The low-pressure gaseous refrigerant is returned to the compressors 4 along the suction line 16 and via the accumulator 18. Pressure and temperature transducers can be used to control the amount of superheating applied to the refrigerant in the evaporator 10. Further superheating of the refrigerant is provided in the suction line 16 as the gaseous refrigerant passes through the SLHX 54 along with the hot liquid refrigerant flowing to the EXV 26. The SLHX 54 thus minimises liquid droplets in the refrigerant returning to the compressors 4 via the suction line 16. In some arrangements, the accumulator 18 can thus be omitted. The three-way valve 56 can be modulated in order to allow some of the liquid refrigerant to bypass the SLHX 54 via the bypass line 58 to provide the desired superheating.

As described for the system 2, the outdoor exchanger 12 has a relatively large volume (which is larger than the evaporator 10 and heat recovery exchanger 14 since it utilises air instead of water) and so a larger refrigerant charge is required in the refrigerant circuit during this mode of operation. In the example shown in FIG. 5, the fill valve 50 is closed and the drain valve 52 is open so as to release the full volume of refrigerant from the receiver, although in other arrangements the fill and drain valves 50, 52 may be modulated as shown in FIG. 1, so as to release the required volume and provide the desired subcooling.

The heat recovery exchanger 14 is not used in the chiller mode and so water does not flow through the hot water supply pipe 15 and the hot water return pipe 17.

The pressure relief valve 60 is activated and gas is supplied to the receiver 48 from the compressors 4 in the event that the outdoor ambient air temperature is lower than the evaporator temperature in the chiller mode.

Figure 6:
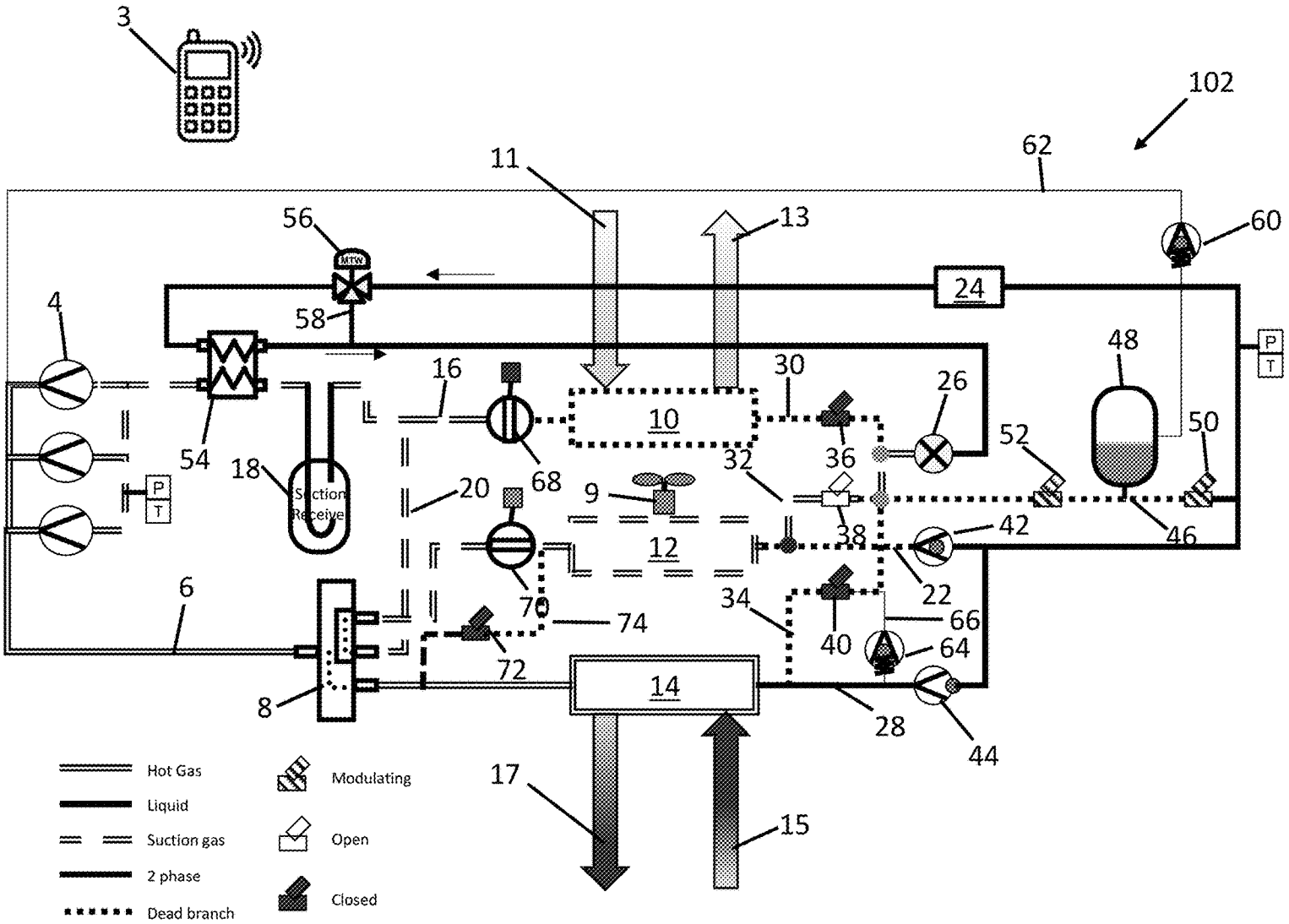
FIG. 6 shows the HVAC system of FIG. 5 operating in a heat pump mode.

FIG. 6 shows the system 102 in the heat pump mode. In the heat pump mode, the four-way valve 8 connects the first port to the fourth port such that the discharge line 6 is connected to the heat recovery exchanger 14. The four-way valve 8 also connects the second port to the third port, such that the outdoor exchanger 12 is connected to the bypass branch 20.

In the heat pump mode, the valves 36 and 40 on the first and third return lines 30, 34 are set in a closed position, whereas the valve 38 on the second return line 32 is set in an open position. The evaporator gas valve 68 is set in a closed position and the outdoor gas valve 70 is set in an open position. The hot gas bypass valve 72 is closed.

Refrigerant in the form of hot, compressed gas is discharged from the compressors 4 to the discharge line 6. The hot, compressed gas passes through the four-way valve 8 to the heat recovery exchanger 14. Water flows into the heat recovery exchanger 14 via the hot water supply pipe 15. The water is cooler than the refrigerant passing through the heat recovery exchanger 14 and so the water absorbs heat from the refrigerant, thereby increasing the temperature of the water and decreasing the temperature of the refrigerant. The heated water is discharged from the heat recovery exchanger 14 via the hot water return pipe 17 and can be used to provide heating to the interior of the building.

In the heat recovery exchanger 14, the hot, compressed gas is therefore cooled by the water which flows through the heat recovery exchanger 14. This causes the refrigerant to condense into liquid form. The liquid refrigerant then exits the heat recovery exchanger 14 via the first liquid line 28 and passes through the drier 24 to the EXV 26 via the three-way valve 56 and the SLHX 54. The EXV 26 reduces the pressure of the refrigerant, thereby also lowering its temperature. Pressure and temperature transducers can be used to control the amount of subcooling applied to the refrigerant in the heat recovery exchanger 14.

The cool, liquid refrigerant passes along the second return line 32 through the open valve 38 and into the outdoor exchanger 12. The fan 9 is activated so as to draw ambient air over the outdoor exchanger 12. The air is warmer than the refrigerant passing through the outdoor exchanger 12 and so the refrigerant absorbs heat from the air, thereby reducing the temperature of the air and increasing the temperature of the refrigerant. The temperature of the refrigerant is increased sufficiently to cause the refrigerant to evaporate back into gaseous form. The outdoor exchanger 12 thus acts as an evaporator in this mode of operation.

The low-pressure gaseous refrigerant passes through the four-way valve 8 and is returned to the compressors 4 along the bypass branch 20 and via the SLHX 54. Pressure and temperature transducers can be used to control the amount of superheating applied to the refrigerant in the outdoor exchanger 12. Further superheating of the refrigerant is provided in the suction line 16 as the gaseous refrigerant passes through the SLHX 54 along with the hot liquid refrigerant flowing to the EXV 26. The SLHX 54 thus minimises liquid droplets in the refrigerant returning to the compressors 4 via the suction line 16. The three-way valve 56 can be modulated in order to allow some of the liquid refrigerant to bypass the SLHX 54 via the bypass line 58 to provide the desired superheating.

As described for the system 2, since the outdoor exchanger 12 is operating as an evaporator in the heat pump mode and thus receiving liquid refrigerant, a smaller refrigerant charge is required during this mode of operation compared with the chiller mode described previously. Accordingly, the fill and drain valves 50, 52 are modulated so as to allow refrigerant to partially fill the receiver 48 in order to ensure that the correct refrigerant charge is present in the circuit.

Figure 7:
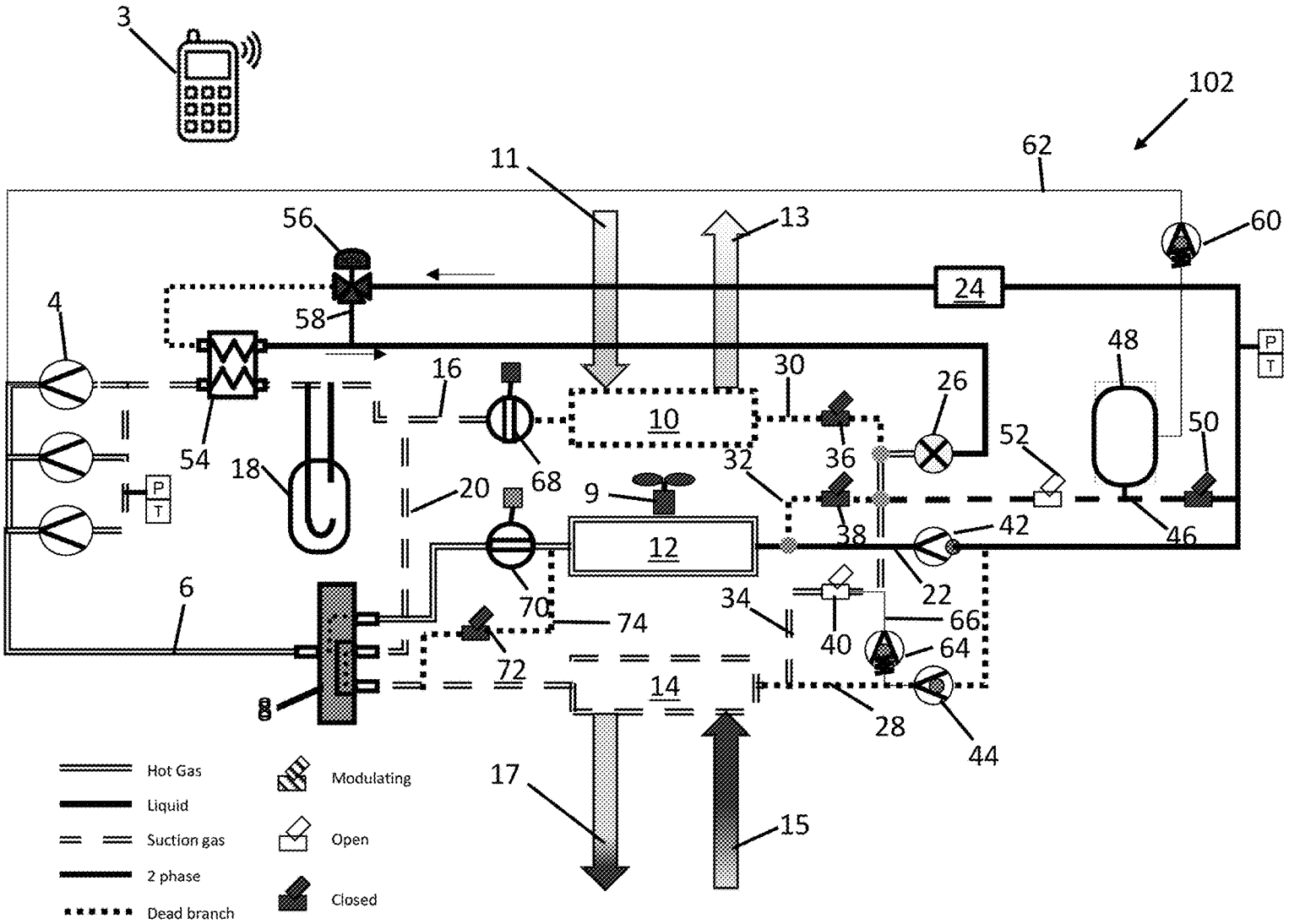
FIG. 7 shows the HVAC system of FIG. 5 operating in a defrost mode.

FIG. 7 shows the system 102 in the defrost mode. In the defrost mode, the four-way valve 8 connects the first port to the second port such that the discharge line 6 is connected to the outdoor exchanger 12. In this mode, the fan 9 of the outdoor exchanger is not operating. The four-way valve 8 also connects the third port to the fourth port, such that the heat recovery exchanger 14 is connected to the bypass branch 20.

In the defrost mode, the valves 36, 38 on the first and second return lines 30, 32 are set in a closed position, whereas the valve 40 on the third return line 34 is set in an open position. The evaporator gas valve 68 is set in a closed position and the outdoor gas valve 70 is set in an open position. The hot gas bypass valve 72 is closed.

Refrigerant in the form of hot, compressed gas is discharged from the compressors 4 to the discharge line 6. The hot, compressed gas passes through the four-way valve 8 to the outdoor exchanger 12 thereby defrosting any ice formed on it. This causes the refrigerant to condense into liquid form. The liquid refrigerant then exits the outdoor exchanger 12 via the first liquid line 22 and passes through the drier 24 to the EXV 26. In this mode, the three-way valve is closed such that all of the refrigerant passes along the bypass line 58 and so bypasses the SLHX 54 entirely. The EXV 26 reduces the pressure of the refrigerant, thereby also lowering its temperature. Pressure and temperature transducers can be used to control the amount of subcooling applied to the refrigerant in the outdoor exchanger 12.

The cool, liquid refrigerant passes along the third return line 34 through the open valve 40 and into the heat recovery exchanger 14. In the defrost mode, water does not flow into or out of the heat recovery exchanger 14 via the hot water supply pipe 15 and the hot water return pipe 17. In the heat recovery exchanger 14, the temperature of the refrigerant is increased sufficiently to cause the refrigerant to evaporate back into gaseous form. The heat recovery exchanger 14 thus acts as an evaporator in this mode of operation.

The low-pressure gaseous refrigerant passes through the four-way valve 8 and is returned to the compressors 4 along the bypass branch 20 and via the accumulator 18. Pressure and temperature transducers can be used to control the amount of superheating applied to the refrigerant in the heat recovery exchanger 14.

As described for the system 2, the refrigerant charge requirement for the defrost mode corresponds to the chiller mode since the outdoor exchanger 12 is used as a condenser in both modes and the evaporator 10 and heat recovery exchanger 14 have a substantially similar volume. Accordingly, like the chiller mode, the defrost mode requires sufficient refrigerant that the receiver 48 is drained entirely of refrigerant. In the defrost mode, the fill valve 50 may be closed and the drain valve 52 modulated so as to slowly release the full volume of the refrigerant from the receiver 48 to the circuit via the third return line 34, thereby improving the defrost efficiency.

The evaporator 10 is not used in the defrost mode and so water does not flow through the cold water supply pipe 11 and the cold water return pipe 13.

Figure 8:
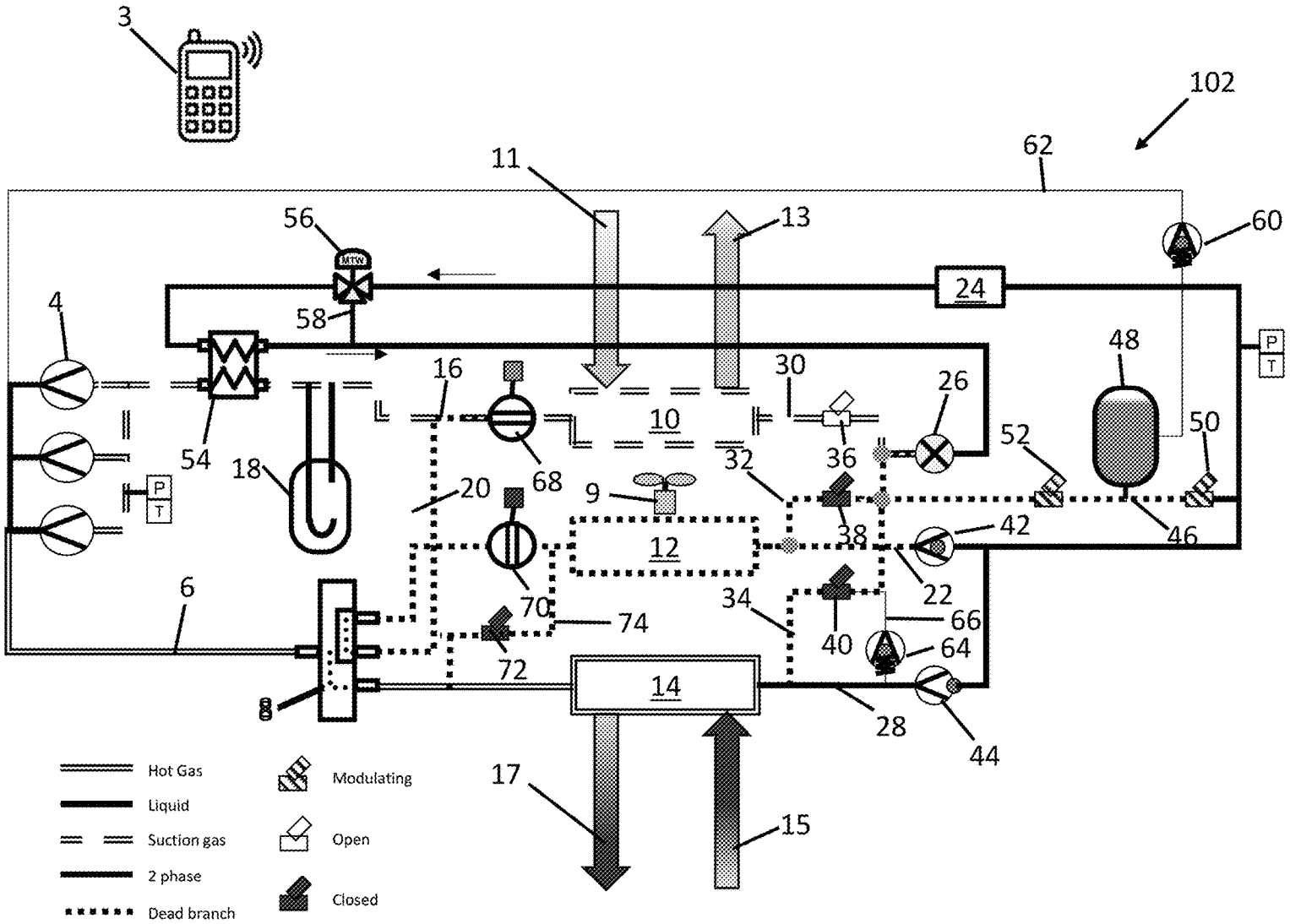
FIG. 8 shows the HVAC system of FIG. 5 operating in a heat recovery mode.

FIG. 8 shows the system 102 in the heat recovery mode. In the heat recovery mode, the four-way valve 8 connects the first port to the fourth port such that the discharge line 6 is connected to the heat recovery exchanger 14. The four-way valve 8 also connects the second port to the third port, although those ports are not used in this mode, as described further below.

In the heat recovery mode, the valves 38 and 40 on the second and third return lines 32, 34 are set in a closed position, whereas the valve 36 on the first return line 30 is set in an open position. The evaporator gas valve 68 is set in an open position and the outdoor gas valve 70 is set in a closed position. The hot gas bypass valve 72 is closed.

Refrigerant in the form of hot, compressed gas is discharged from the compressors 4 to the discharge line 6. The hot, compressed gas passes through the four-way valve 8 to the heat recovery exchanger 14. Water flows into the heat recovery exchanger 14 via the hot water supply pipe 15. The water is cooler than the refrigerant passing through the heat recovery exchanger 14 and so the water absorbs heat from the refrigerant, thereby increasing the temperature of the water and decreasing the temperature of the refrigerant. The heated water is discharged from the heat recovery exchanger 14 via the hot water return pipe 17 and can be used to provide heating to the interior of the building.

In the heat recovery exchanger 14, the hot, compressed gas is therefore cooled by the water which flows through the heat recovery exchanger 14. This causes the refrigerant to condense into liquid form. The liquid refrigerant then exits the heat recovery exchanger 14 via the first liquid line 28 and passes through the drier 24 to the EXV 26 via the three-way valve 56 and the SLHX 54. The EXV 26 reduces the pressure of the refrigerant, thereby also lowering its temperature. Pressure and temperature transducers can be used to control the amount of subcooling applied to the refrigerant in the heat recovery exchanger 14.

The cool, liquid refrigerant passes along the first return line 30 through the open valve 36 and into the evaporator 10. Water flows into the evaporator 10 via the cold water supply pipe 11. The water is warmer than the refrigerant passing through the evaporator 10 and so the refrigerant absorbs heat from the water, thereby reducing the temperature of the water and increasing the temperature of the refrigerant. The temperature of the refrigerant is increased sufficiently to cause the refrigerant to evaporate back into gaseous form. The cooled water is discharged from the evaporator 10 via the cold water return pipe 13 and can be used to provide cooling to the interior of a building.

The low-pressure gaseous refrigerant is returned to the compressors 4 along the suction line 16 and via the SLHX 54. Pressure and temperature transducers can be used to control the amount of superheating applied to the refrigerant in the evaporator 10. Further superheating of the refrigerant is provided in the suction line 16 as the gaseous refrigerant passes through the SLHX 54 along with the hot liquid refrigerant flowing to the EXV 26. The SLHX 54 thus minimises liquid droplets in the refrigerant returning to the compressors 4 via the suction line 16. The three-way valve 56 can be modulated in order to allow some of the liquid refrigerant to bypass the SLHX 54 via the bypass line 58 to provide the desired superheating.

As described for the system 2, in the heat recovery mode, the refrigerant charge requirement is at its minimum. Accordingly, in this mode, the fill and drain valves 50, 52 are modulated such that the receiver 48 fills with refrigerant until it is almost full. This reduces the effective refrigerant charge in the circuit and thus ensures efficient operation.

Figure 9:
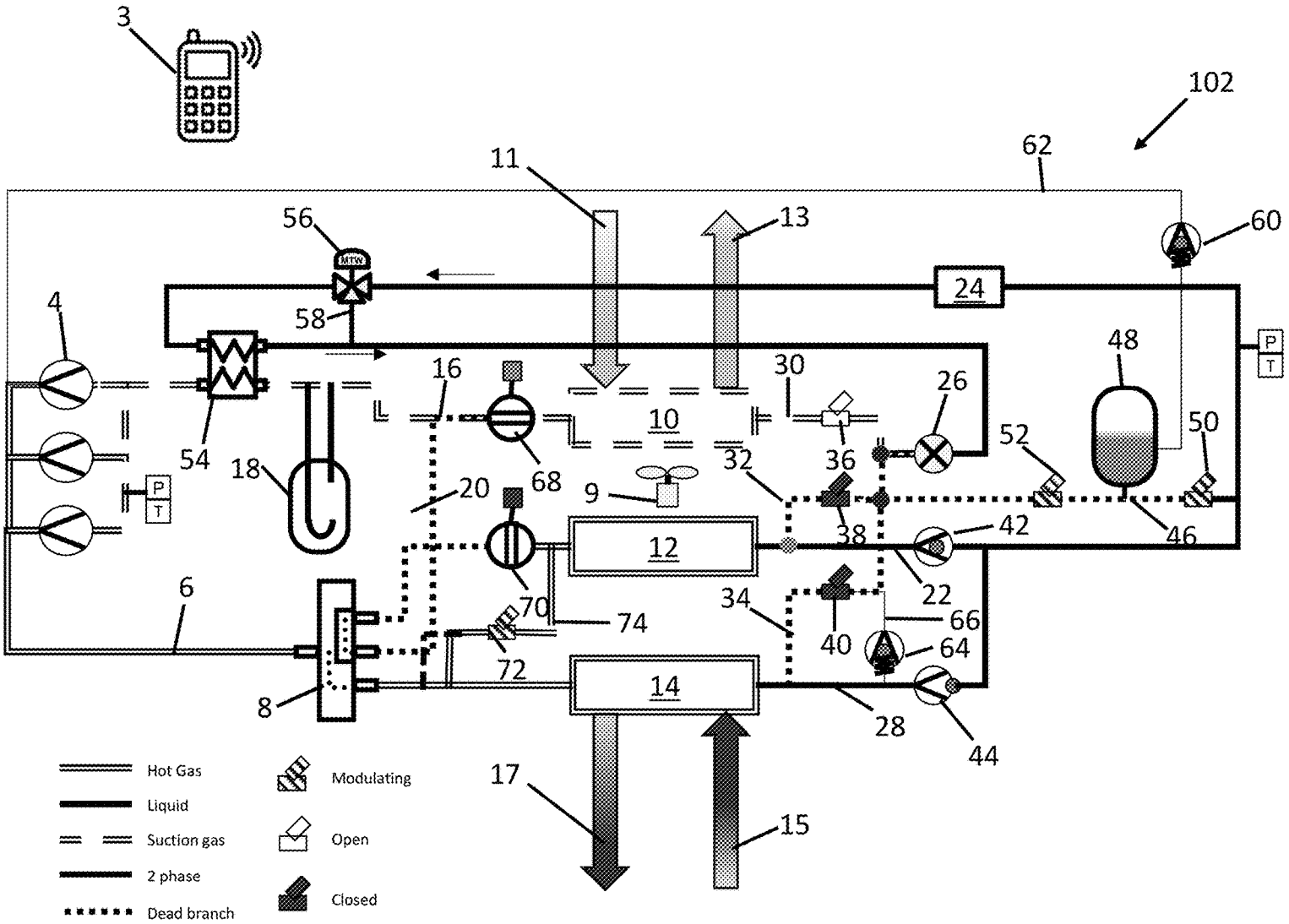
FIG. 9 shows the HVAC system of FIG. 5 operating in a partial heat recovery mode.

FIG. 9 shows the system 102 in a partial heat recovery mode which may be used when the heat recovery demand is lower than the cooling demand. The partial heat recovery mode corresponds to the heat recovery mode, except that the hot gas bypass valve 72 is modulated in order to allow some of the hot gas to be diverted from the heat recovery exchanger 14 and instead flow to the outdoor exchanger 12.

In the outdoor exchanger 12, the hot, compressed gas is cooled by the outdoor air which flows over coils of the outdoor exchanger 12 by virtue of the fan 9 (which may be operating at a slower speed compared to the chiller mode). In the heat recovery exchanger 14, the hot, compressed gas is cooled by the water which flows through the heat recovery exchanger 14. This causes the refrigerant to condense into liquid form in both the outdoor exchanger 12 and the heat recovery exchanger 14. By diverting some of the hot, compressed gas to the outdoor exchanger 12, the increase in temperature of the water flowing through the heat recovery exchanger 14 is reduced.

The liquid refrigerant then exits the outdoor exchanger 12 via the first liquid line 22 and the heat recovery exchanger 14 via the second liquid line 28 and passes through the drier 24 to the EXV 26 via the three-way valve 56 and the SLHX 54, as per the heat recovery mode.

Like the heat recovery mode, the cool, liquid refrigerant passes along the first return line 30 through the open valve 36 and into the evaporator 10 and is used to cool the water flowing through the evaporator 10.

As the refrigerant also passes through the outdoor exchanger 12 in the partial heat recovery mode, the required refrigerant charge is greater than for the heat recovery mode. Accordingly, in the partial heat recovery mode, the fill and drain valves 50, 52 are modulated such that the receiver 48 is partially filled, although it stores less of the refrigerant compared to the heat recovery mode.

As described, the required refrigerant charge for optimum performance varies considerably based on the operating mode currently being used, particularly due to the larger internal volume of the outdoor exchanger 12 compared to the evaporator 10 and heat recovery exchanger 14. The systems 2, 102 allow the effective refrigerant charge present in the circuit to be easily controlled based on the current operating mode. This ensures that the refrigerant charge is optimised in all operating modes, providing improved performance. The circuit is arranged such that refrigerant always flows in the same direction through the EXV 26. Further, the receiver line 46 is arranged such that the fill valve 50 is always at a higher pressure than the drain valve 52. The receiver line 46 is therefore always able to fill and drain the receiver 48 in all operating modes. The release of the refrigerant from the receiver can also be used to control the refrigerant liquid subcooling.

The volume of the receiver 48 does not need to be accurately sized and can be larger than required since the system is able to accurately control the effective refrigerant charge in the system. Likewise, the total refrigerant charge (i.e. including the refrigerant present in the receiver) can be larger than required. Accordingly, the receiver arrangement saves time when setting up the system since the volume of refrigerant does not need to be accurately measured.

In other examples, the SLHX 54 (and the three-way valve 56) and hot gas bypass valve 72 (and its bypass line 74) may be omitted, as per the system 2.

In both the system 2 and the system 102, the valves 36, 38, 40 may be step motor valves. The valves 36, 38, 40 may have sufficient leakage rates that it is necessary to provide a check valve between the valve 36 and the evaporator 10, between the valve 38 and the outdoor exchanger 12, and between the valve 40 and the heat recovery exchanger 14. Leakage through the valves 36, 38, 40 may mean that the pressure relief valve 64 and drain line 66 of system 102 provided to release trapped refrigerant can be omitted.

Although the valve 60 has been described as a pressure relief valve, it may instead be a solenoid valve or other actuated valve. Such a valve may provide sufficient leakage to allow liquid refrigerant to flow back to the discharge line 6, thereby avoiding excessive pressure when the valve is closed and the receiver 48 is full of liquid.

The invention claimed is:

1. A HVAC system comprising: a fluid circuit for conveying a refrigerant; a compressor for compressing the refrigerant; three heat exchangers defining an evaporator, an outdoor exchanger and a heat recovery exchanger provided along the fluid circuit; an expansion valve provided along the fluid circuit; and a receiver connected in parallel to the expansion valve, wherein a fill valve is located between the receiver and a connection upstream of the expansion valve and a drain valve is located between the receiver and a connection downstream of the expansion valve; wherein the fluid circuit comprises a plurality of valves which are configured to be controlled based on a selected operating mode such that at least one of the outdoor exchanger and the heat recovery exchanger is connected to a discharge line of the compressor and in series with one of the other heat exchangers which is connected to a suction line of the compressor, with the expansion valve disposed between: at least one of said outdoor exchanger and said heat recovery exchanger, and another one of said three heat exchangers, wherein the selected operating mode is selected from one or more operating modes including a partial heat recovery mode in which both the heat recovery exchanger and the outdoor exchanger are connected to the discharge line and the evaporator is connected to the suction line; wherein, in the partial heat recovery mode, a hot gas bypass valve upstream of the heat recovery exchanger diverts refrigerant to the outdoor exchanger in order to control the heat recovery at the heat recovery exchanger; wherein the fill valve and the drain valve are configured to be controlled to store a volume of refrigerant in the receiver so as to provide an effective refrigerant charge in the fluid circuit that corresponds to the selected operating mode.

2. A HVAC system according to claim 1, wherein the evaporator and/or the heat recovery exchanger are refrigerant to water heat exchangers and/or the outdoor exchanger is a refrigerant to air heat exchanger.

3. A HVAC system according to claim 1, wherein an internal volume of the outdoor exchanger is larger than an internal volume of the heat recovery exchanger and/or the evaporator.

4. A HVAC system according to claim 1, wherein the one or more operating modes further includes one or more of the following:

- a chiller mode in which the outdoor exchanger is connected to the discharge line and the evaporator is connected to the suction line;
- a heat pump mode in which the heat recovery exchanger is connected to the discharge line and the outdoor exchanger is connected to the suction line;
- a defrost mode in which the outdoor exchanger is connected to the discharge line and the heat recovery exchanger is connected to the suction line;
- a heat recovery mode in which the heat recovery exchanger is connected to the discharge line and the evaporator is connected to the suction line; and.

5. A HVAC system according to claim 4, wherein the effective refrigerant charge required for the chiller mode is greater than for the heat pump mode; and/or wherein the effective refrigerant charge required for the defrost mode is greater than for the heat pump mode; and/or wherein the effective refrigerant charge required for the heat pump mode is greater than for the heat recovery mode.

6. A HVAC system according to claim 1, wherein the plurality of valves comprises a four-way valve which is configured to connect one of the outdoor exchanger and the heat recovery exchanger to the discharge line and the other of the outdoor exchanger and the heat recovery exchanger to the suction line via a bypass branch.

7. A HVAC system according to claim 1, wherein the fluid circuit comprises a liquid line connected between the expansion valve and each of the heat recovery exchanger and the outdoor exchanger, wherein the liquid lines are provided on an upstream side of the expansion valve.

8. A HVAC system according to claim 1, wherein the fluid circuit comprises a return line connected between the expansion valve and each of the heat exchangers, wherein the return lines are provided on a downstream side of the expansion valve.

9. A HVAC system according to claim 8, wherein the plurality of valves comprises a valve provided along each of the return lines so as to allow said another of the three heat exchangers which is connected to the suction line of the compressor to be connected to the expansion valve.

10. A HVAC system according to claim 1, further comprising a pressure line connecting the discharge line to the receiver and having a pressure relief valve disposed between the compressor and the receiver.

11. A HVAC system according to claim 1, further comprising a drier located upstream of the expansion valve.

12. A HVAC system according to claim 1, further comprising a controller which controls the plurality of valves in response to the selected operating mode.

13. A HVAC system according to claim 1, wherein the evaporator comprises a cold water supply pipe and a cold water return pipe, and the heat recovery exchanger comprises a hot water supply pipe and a hot water return pipe.

14. A HVAC system, comprising:

a fluid circuit for conveying a refrigerant;

a compressor for compressing the refrigerant;

three heat exchangers defining an evaporator, an outdoor exchanger and a heat recovery exchanger provided along the fluid circuit;

an expansion valve provided along the fluid circuit; and a receiver connected in parallel to the expansion valve, wherein a fill valve is located between the receiver and a connection upstream of the expansion valve and a drain valve is located between the receiver and a connection downstream of the expansion valve;

wherein the fluid circuit comprises a plurality of valves which are configured to be controlled based on a selected operating mode such that at least one of the outdoor exchanger and the heat recovery exchanger is connected to a discharge line of the compressor and in series with one of the other heat exchangers which is connected to a suction line of the compressor, with the expansion valve disposed between:

at least one of said outdoor exchanger and said heat recovery exchanger, and another one of said three heat exchangers;

wherein the fill valve and the drain valve are configured to be controlled to store a volume of refrigerant in the receiver so as to provide an effective refrigerant charge in the fluid circuit that corresponds to the selected operating mode, and further comprising a suction line heat exchanger connected to a portion of the fluid circuit which is upstream of the expansion valve and to the suction line.

15. A HVAC system according to claim 14, wherein a bypass line is provided across the suction line heat exchanger on the portion of the fluid circuit which is upstream of the expansion valve; wherein a valve is provided for controlling the flow of refrigerant through the bypass line in order to bypass the suction line heat exchanger.

* * * * *